US010688004B2

(12) United States Patent
Holladay

(10) Patent No.: US 10,688,004 B2
(45) Date of Patent: Jun. 23, 2020

(54) OVERLAY SUPPORT PAD FOR MEDICAL BEAN BAG DEVICE

(71) Applicant: Prime Medical, LLC, Knoxville, TN (US)

(72) Inventor: David Holladay, Knoxville, TN (US)

(73) Assignee: Prime Medical, LLC, Knoxville, TN (US)

( * ) Notice: Subject to any disclaimer, the term of this patent is extended or adjusted under 35 U.S.C. 154(b) by 262 days.

(21) Appl. No.: 15/427,950

(22) Filed: Feb. 8, 2017

(65) Prior Publication Data

US 2017/0231849 A1 Aug. 17, 2017

Related U.S. Application Data

(60) Provisional application No. 62/292,562, filed on Feb. 8, 2016.

(51) Int. Cl.

| | |
|---|---|
| ***A61G 13/12*** | (2006.01) |
| ***A47C 27/14*** | (2006.01) |
| ***A47C 31/10*** | (2006.01) |
| *A61G 7/057* | (2006.01) |

(52) U.S. Cl.

CPC ..... *A61G 13/126* (2013.01); *A47C 27/14* (2013.01); *A47C 31/105* (2013.01); *A61G 7/05738* (2013.01)

(58) Field of Classification Search

CPC ..... A61G 13/12
USPC ..... 5/600, 621–624
See application file for complete search history.

(56) References Cited

U.S. PATENT DOCUMENTS

| | | | |
|---|---|---|---|
| 2,764,150 | A | 9/1956 | Ettinger et al. |
| 2,835,902 | A | 5/1958 | Fash |
| 3,227,440 | A | 1/1966 | Scott |
| 3,780,387 | A | 12/1973 | Propst |
| 4,840,362 | A | 6/1989 | Bremer et al. |
| 4,884,304 | A | 12/1989 | Elkins |
| 5,054,142 | A | 10/1991 | Owens |
| 5,269,035 | A | 12/1993 | Hartunian |
| 5,306,231 | A | 4/1994 | Cullum et al. |
| 5,362,302 | A | 11/1994 | Jensen et al. |
| 5,448,790 | A | 9/1995 | Saro et al. |
| 5,486,206 | A | 1/1996 | Avery |

(Continued)

FOREIGN PATENT DOCUMENTS

| | | |
|---|---|---|
| EP | 0977517 | 7/2005 |
| EP | 1635757 | 6/2010 |

(Continued)

OTHER PUBLICATIONS

Prime Medical, Bean Bag Pressure/Protection Pad, Primemedicalllc.com, Prime Medical, Oct. 7, 2015. Web <http://primemedicalllc.com/wp-content/uploads/2015110/BBPPP.pdf>.

(Continued)

*Primary Examiner* — Fredrick C Conley
(74) *Attorney, Agent, or Firm* — Pitts & Lake, P.C

(57) ABSTRACT

A patient positioning overlay pad which works in conjunction with a bean bag device to fill gaps in the bean bag device when the bean bag device conforms to a shape of the body, the overlay pad providing support, protection, and comfort for a patient when the patient is positioned on an operating room table in a predetermined position during a medical procedure.

20 Claims, 4 Drawing Sheets

(56) References Cited

U.S. PATENT DOCUMENTS

| | | | | |
|---|---|---|---|---|
| 5,661,860 | A | 9/1997 | Heitz | |
| 5,837,002 | A | 11/1998 | Augustine et al. | |
| 5,893,183 | A | 4/1999 | Bechtold, Jr. | |
| 6,237,172 | B1 | 5/2001 | Morgan, Sr. | |
| 6,401,283 | B2 | 6/2002 | Thomas et al. | |
| 6,484,334 | B1 * | 11/2002 | Borders | A61F 7/007 5/600 |
| 6,516,483 | B1 | 2/2003 | Van Steerburg | |
| 6,541,094 | B1 | 4/2003 | Landvik et al. | |
| 6,578,219 | B1 * | 6/2003 | Gabel | A61G 7/05715 5/600 |
| 6,653,363 | B1 | 11/2003 | Tursi, Jr. et al. | |
| 6,701,558 | B2 | 3/2004 | VanSteenburg | |
| 6,817,363 | B2 | 11/2004 | Biondo et al. | |
| 6,904,631 | B2 | 6/2005 | Yrzalik et al. | |
| 6,933,469 | B2 | 8/2005 | Ellis et al. | |
| 7,179,255 | B2 | 2/2007 | Lettice et al. | |
| 7,240,384 | B2 | 7/2007 | DuDonis | |
| 7,555,794 | B2 | 7/2009 | Zelnik et al. | |
| 7,603,730 | B2 | 10/2009 | Zelnik | |
| 7,731,282 | B2 | 6/2010 | Leeds | |
| 7,731,283 | B2 | 6/2010 | Leeds | |
| 7,757,318 | B2 | 7/2010 | Poulos et al. | |
| 7,789,461 | B2 | 9/2010 | Leeds | |
| 7,971,298 | B2 * | 7/2011 | Kobu | A61G 13/1255 5/621 |
| 8,011,045 | B2 | 9/2011 | Skripps | |
| 8,464,720 | B1 | 6/2013 | Pigazzi et al. | |
| 8,511,314 | B2 | 8/2013 | Pigazzi et al. | |
| 8,539,621 | B2 | 9/2013 | West | |
| 8,756,733 | B2 | 6/2014 | Hughes et al. | |
| 2005/0187598 | A1 | 8/2005 | Shimizu et al. | |
| 2005/0210595 | A1 | 9/2005 | Di Stasio et al. | |
| 2006/0016016 | A1 | 1/2006 | Hornbach | |
| 2008/0178390 | A1 | 7/2008 | DuDonis | |
| 2009/0142551 | A1 | 6/2009 | Fox et al. | |
| 2010/0005595 | A1 * | 1/2010 | Gladney | A47C 27/148 5/691 |
| 2010/0275377 | A1 | 11/2010 | West | |
| 2010/0281617 | A1 | 11/2010 | Brun | |
| 2011/0034887 | A1 | 2/2011 | Forden et al. | |
| 2011/0047706 | A1 | 3/2011 | Hiebert | |
| 2011/0163581 | A1 * | 7/2011 | Leeds | A47C 7/021 297/229 |
| 2012/0015151 | A1 | 1/2012 | Pearce et al. | |
| 2012/0255124 | A1 | 10/2012 | West | |
| 2013/0174853 | A1 | 7/2013 | Pigazzi et al. | |
| 2013/0312189 | A1 | 11/2013 | Sarma et al. | |
| 2014/0352072 | A1 | 12/2014 | Holladay | |

FOREIGN PATENT DOCUMENTS

| | | |
|---|---|---|
| GB | 2484885 | 5/2012 |
| WO | WO2013/106426 | 7/2013 |
| WO | 2016102960 | 6/2016 |

OTHER PUBLICATIONS

Prime Medical, Trendelenburg O.R. Table Pad, Primemedicalllc.com. Prime Medical, Aug. 5, 2015. Web <http://primemedicalllc.com/wp-content/uploads/2015/09/STP-family715-revision.pdf>.

Patent Cooperation Treaty, Int'l Search Report, dated Jun. 2, 2017; Form PCT/ISA220.

J. Klauschie, MD, et al "Use of Anti-Skid Material and Patient-Positioning to Prevent . . . ", The Journal of Minimally Invasive Gynecology, vol. 17 No. 4, p. 504-507, Aug. 2010.

Patent Cooperation Treaty; Int'l Search Report; Form PCT/ISA/220; dated Dec. 3, 2014.

Federal Aviation Administration; Aircraft Certi. Division; Flammability Requirements for Aircraft Seat Cushions Section 25.853-1.17; https://www.fire.tc.faa.gov/pdf/25-856.pdf.

Meridian Medical; Surgical Positioners Brochure, Apr. 3, 2012.

Patent Cooperation Treaty; International Preliminary Report on Patentability; Form PCT/IB/373; dated Dec. 3, 2014.

Extended European Search Report; EPO Form 1507S, European patent office dated Aug. 1, 2019.

* cited by examiner

OVERLAY SUPPORT PAD FOR MEDICAL BEAN BAG DEVICE

CROSS-REFERENCE TO RELATED APPLICATIONS

This application claims the benefit of U.S. Provisional Patent Application Ser. No. 62/292,562, filed on Feb. 8, 2016, the disclosure of which is incorporated herein in its entirety by reference.

FIELD OF INVENTION

The present general inventive concept relates to a patient positioning overlay pad which works in conjunction with a bean bag device to provide protection, support, and comfort for a patient when the patient is positioned on an operating room table in a predetermined position during a medical procedure using a bean bag device.

BACKGROUND OF THE INVENTION

It is known to provide surface covers for operating tables to support a patient on the operating table during a medical procedure. Efforts regarding such devices have led to continuing developments to improve their versatility, practicality, functionality, efficiency, efficacy, and convenience of use.

One type of pad that is well known in the art, which is used to provide support to a patient during a medical procedure, is a bean bag device. Such a device can be made of dried beans, polyvinyl chloride pellets, expanded polystyrene or expanded polypropylene. While such pads generally conform to the shape of the patient and provide stability to patients in different positions, pressure points can arise during the use of such bean bag devices when the device is maneuvered into a support position and wrinkles or other surface irregularities can form in the bean bag device. Another type of pad for providing support to a patient during a medical procedure is a gel pad. Such gel pads are used for their ability to provide shape conformance as well as comfort to a patient during a medical procedure.

Accordingly, there is a need in the art for a gel overlay pad that is used in conjunction with a bean bag pad to provide protection, support, and comfort for a patient when the patient is positioned on an operating room table in a predetermined position during a medical procedure using a bean bag device.

BRIEF SUMMARY

Embodiments of the present general inventive concept provide an overlay pad arrangement including a bean bag device, and a gel-infused foam pad configured in shape and size to support a patient on an operating room table, the gel-infused foam pad having characteristics which improve the versatility, practicality, functionality, efficiency, efficacy, and convenience of use.

Additional aspects and features of the present general inventive concept will be set forth in part in the description which follows, and, in part, will be obvious from the description, or may be learned by practice of the present general inventive concept.

Example embodiments of the present general inventive concept may be achieved by providing an overlay pad arrangement for use with a patient positioning bean bag device for patient support, including a polyurethane visco-elastic foam overlay pad configured to support a patient on an operating room table, with the overlay pad having a top surface configured to conform with the patient's anatomy when the overlay pad is positioned between the bean bag device and the patient's body, and a bottom surface configured to conform with an outer surface of the bean bag device and bridge and fill gaps between rigid protuberances in the outer surface to reduce pressure points of the bean bag device against the patient's skin and increase skin protection of the patient's skin against the outer surface a surgical pad including a foam pad configured to support a patient on an operating room table, the foam pad comprising a gel-infused polyurethane visco-elastic foam.

The foam overlay pad may have a density of approximately 3.6 to 3.9 lbs/ft$^3$.

The foam overlay pad may be made from gel-infused foam.

The overlay pad may be configured to be rolled-up for shipping and/or storage, and may be configured to return to its original flat shape immediately upon being unrolled.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Reference will now be made to various example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Figure 1:
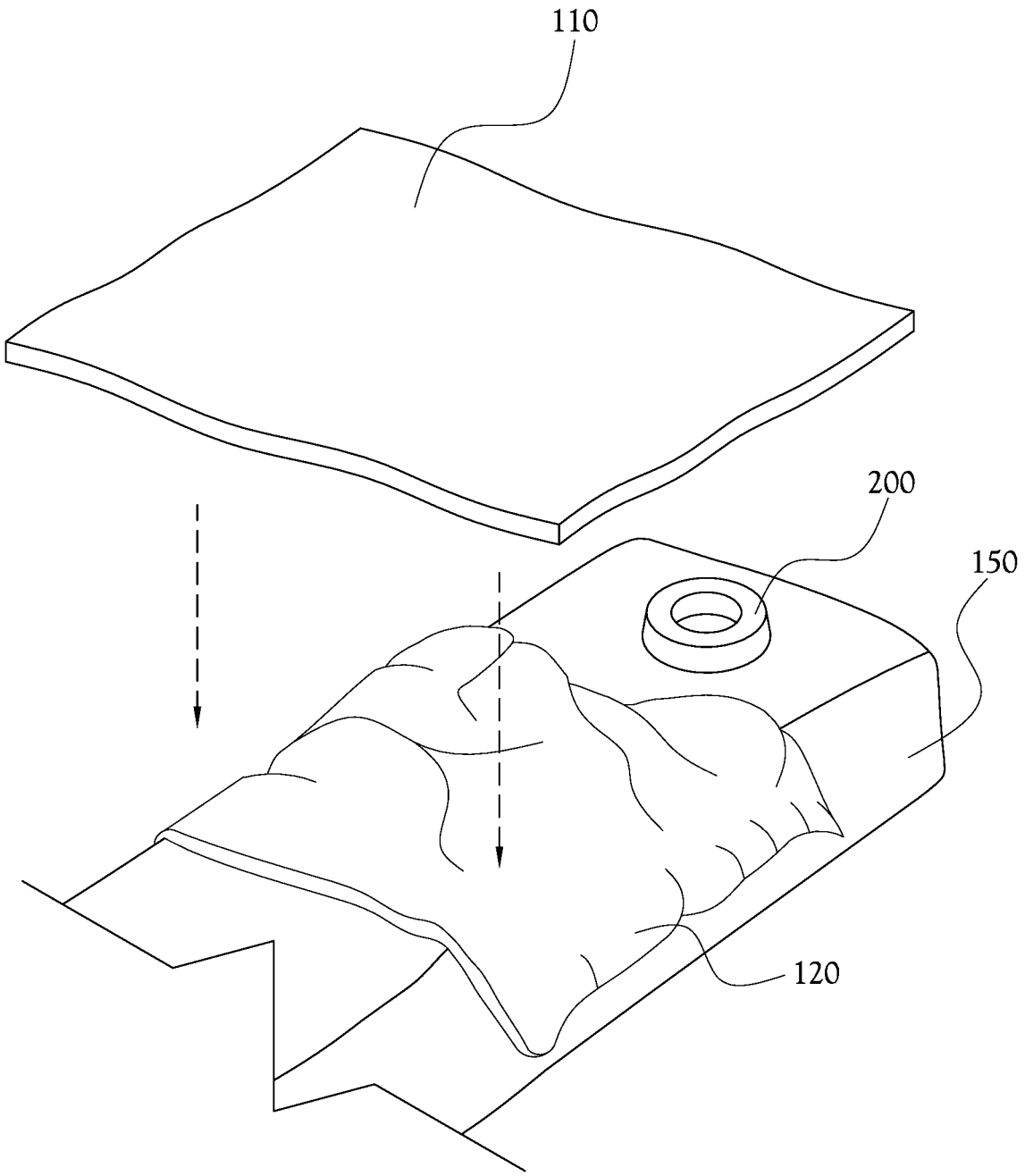
FIG. 1 illustrates an overlay pad and bean bag device according to an example embodiment of the present general inventive concept.
Figure 2:
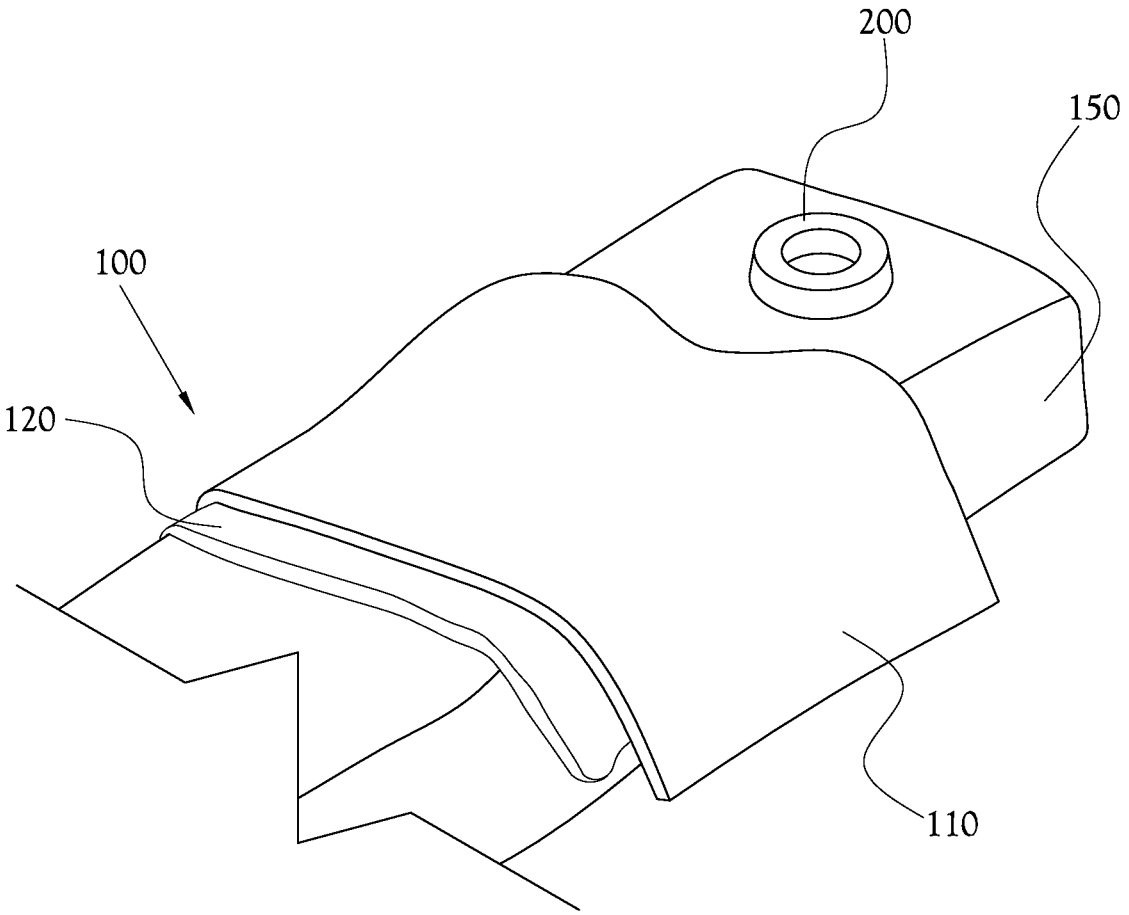
FIG. 2 illustrates an overlay pad and bean bag device according to an example embodiment of the present general inventive concept.
Figure 3:
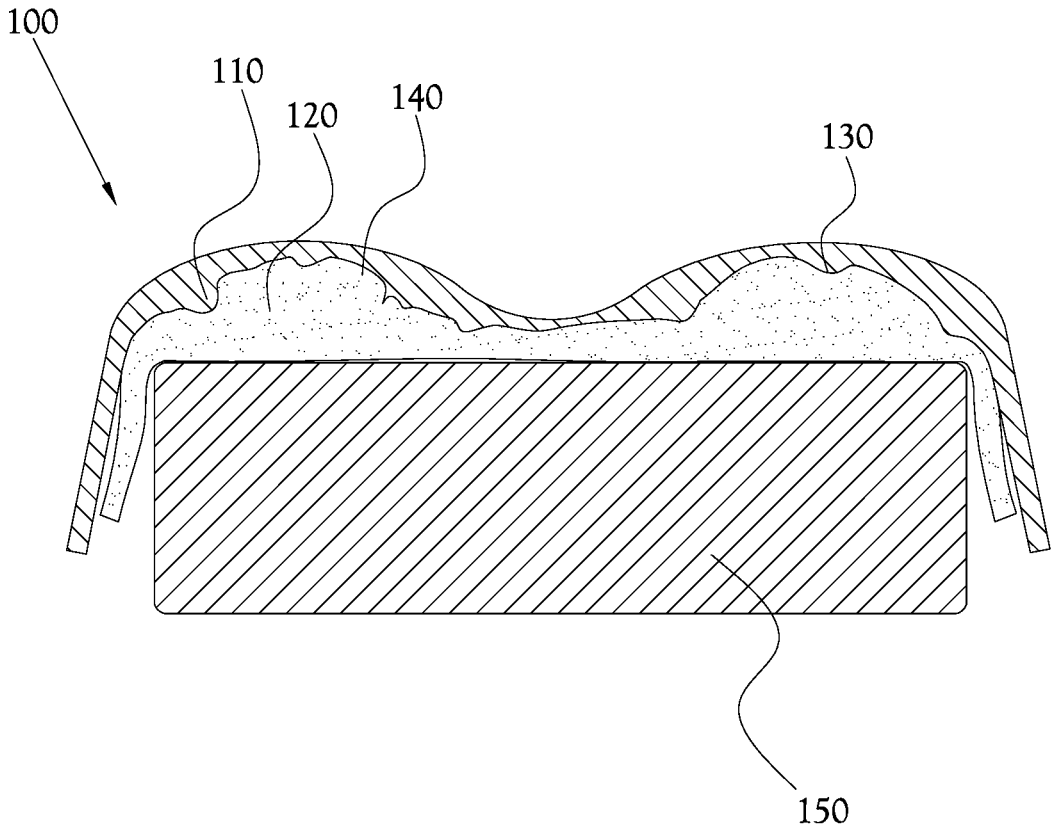
FIG. 3 illustrates a sectional view of the overlay pad and bean bag device of FIG. 2.

In various example embodiments shown in FIGS. 1-3, the present general inventive concept provides an overlay pad arrangement 100 configured to be used in various medical procedures, the overlay pad arrangement 100 including a foam overlay pad 110 used in conjunction with a bean bag device 120 configured to support a patient on an operating room table 104, and including a gel-infused polyurethane and/or visco-elastic foam. The overlay foam pad 110 may be at least approximately one inch thick. As used herein, the term "gel-infused" foam refers to what is commonly known as 100% gel-infused polyurethane high density foam. This is distinguishable from foams that merely contain gel beads or other gel components added to the foam without having gel completely mixed into the material.

As shown in FIGS. 1-3, the overlay pad 110 can be configured to overlay on a bean bag device 120 between the patient and the bean bag 120 such that when the bean bag device 120 is activated to create a substantially fixed support structure to hold the patient in a predetermined surgical position, for example the lateral position, the overly pad 110 is configured to lie between the outer surface of the bean bag device 120 and the patient such that the overlay pad 110 conforms to the shape of the patient's anatomy and reduces pressure points between the bean bag 120 and patient's body, and provides protection for the patient's skin against the bean bag 120 surface.

FIG. 1 shows the overly pad 110 as it rests above the bean bag 120 prior to being placed directly on the bean bag 120. Also shown in FIG. 1 is a head rest 200 for the patient. FIG. 2 shows the overlay pad 110 resting on the bean bag 120, in position for the patient in position for a patient during a medical procedure. FIGS. 1-3 also show where the overlay pad arrangement 100 lays on a mattress 150, although the overlay pad arrangement 100 may lay directly on an operating room table 104.

FIG. 3 is a sectional view of the overlay pad 110 as it rests on the bean bag device 120. As illustrated in FIG. 3, the gel-infused foam material of the overlay pad 110 is designed to bridge the relatively rigid gaps that can be formed in wrinkles 130 or other surface irregularities in the bean bag 120 when the bag is maneuvered into an appropriate support position. Rigid protuberances 140 created in the outer surface of the bean bag 120 when the bag 120 is positioned can be smoothed by the overlay pad 110 because portions of the mating outer surfaces of the gel infused overlay pad 110 are designed to bridge and fill depressions in the bean bag 120 that otherwise may press against the patient's body, thus reducing pressure points against the patient's skin and increasing skin protection of the patient against the bean bag 120 surface, while the overlay pad 110 simultaneously maintains substantial conformity with the overall shape and configuration of the bean bag 120. When the surface of the overlay pad 110 contacts a raised portion of the bean bag 120, the cellular structure of the overlay pad 110 allows portions of the material to be drawn down into the wrinkles and crevices of the bean bag 120 to form a smooth and continuous interface, where the bottom surface of the overlay pad mates continuously with the outer surface of the bean bag. In this way, the bottom surface of the bean bag 120, by virtue of the gel material, is merged into the crevices and protuberances of the bean bag device such that the two surfaces are melded together. This effectuates a novel and inventive approach for solving the problem of comfortably, and accurately, supporting a patient in a medical procedure by merging the bottom surface of the overlay pad with the wrinkled outer surface of the bean bag device, where the bottom surface of the overlay pad conforms with the wrinkles of the bean bag device such that the cellular structure and thickness of the overlay pad is configured to absorb the wrinkled configuration of the bottom surface of the overlay pad when the bottom surface is mated, or merged, with the wrinkled surface of the bean bag device, such that the top surface of the overlay pad is smoothed, or non-wrinkled, relative to the bottom surface, yet the upper surface of the overlay pad is configured to follow the trajectory of the larger hills and valleys, without presenting the upper surface with the smaller wrinkles and gaps found in the outer surface of the bean bag device. In this way, the bean bag 120 provides support for the 'rough', or 'coarse' positioning of the patient on the table 104, while the overlay pad 110 is configured to provide a 'fine' positioning by virtue of the bottom surface of the overlay pad being configured to fill the small gaps and wrinkles (i.e., bridge the gaps) created in the outer surface of the bean bag device, and the thickness of the cellular gel structure of the overlay pad is configured to absorb such wrinkles and present a fine, smooth upper surface of the pad, i.e., following the geometry of the larger hills and valleys of the bean bag device without subjecting the patient's body to the discontinuities that would otherwise be present in the smaller wrinkles and gaps within such smoother hills and valleys, thus fine tuning the support by providing a smooth, comfortable surface that eliminates pressure points attributable to such wrinkles and gaps, yet securely maintains the patient accurately in position, i.e., without allowing the body to move with respect to small gaps and wrinkles in the bean bag device.

Figure 4A:
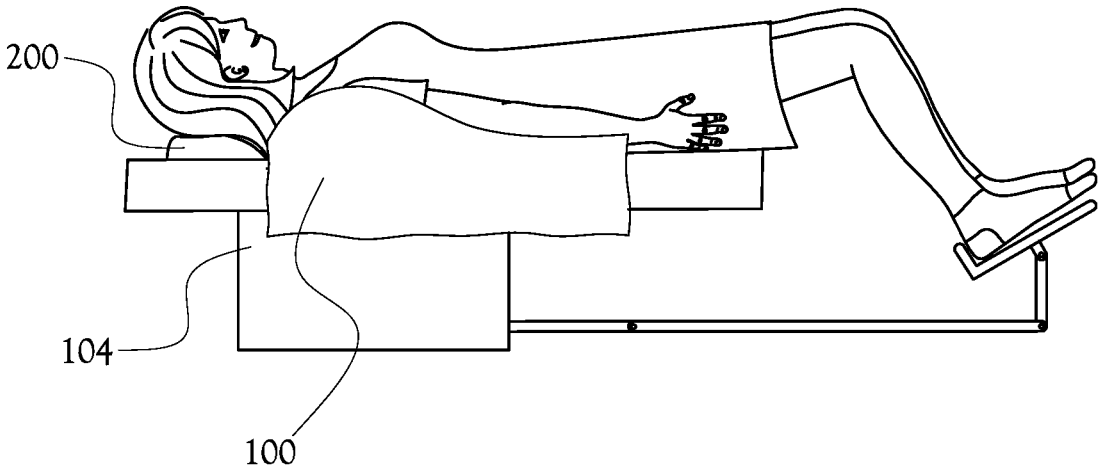
FIGS. 4A-4B illustrate two other example uses of the overlay pad arrangement according to an example embodiment of the present general inventive concept.
Figure 4B:
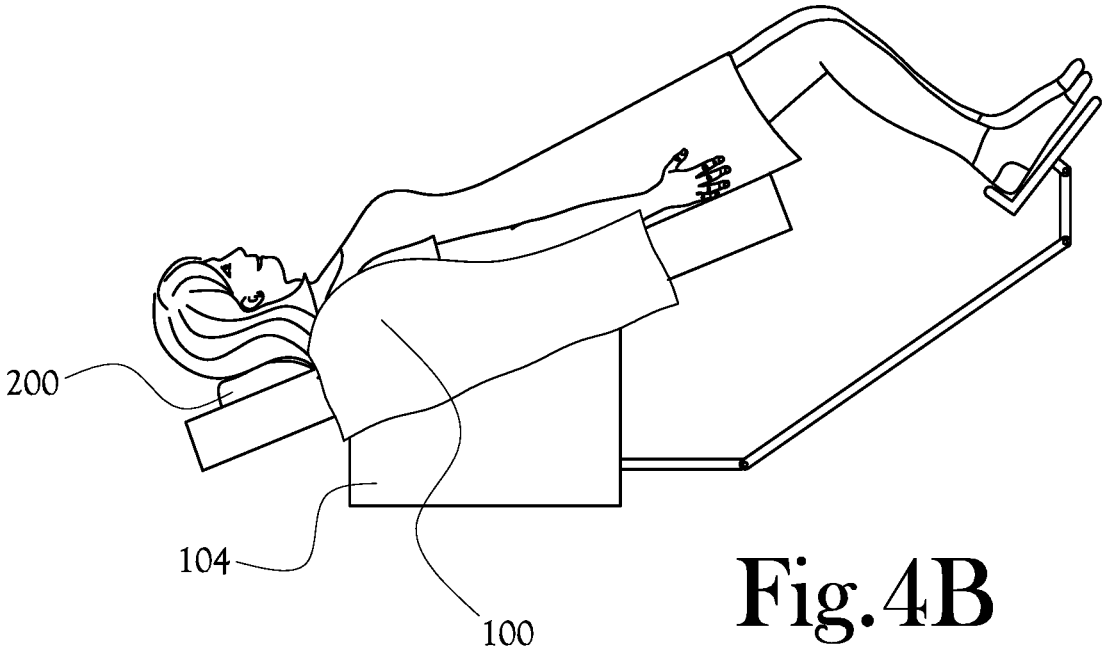

FIGS. 4A and 4B illustrate overlay pad arrangements 100 according to an example embodiment of the present general inventive concept. It is noted that the term overlay pad 110 may be used interchangeably herein with similar terms such as operating table pad, surgical pad, or simply pad. The overlay pad arrangement 100 is configured to be used in any of a number of various medical procedures and in different positions as shown in FIGS. 4A and 4B. The example embodiment illustrated in FIGS. 4A and 4B may be supported by a substantially upward-facing table-top such as a surgical table 104, which may be interchangeably referred to herein as an operating room table, operating table, or simply a table. FIGS. 4A-4B illustrate example uses of the overlay pad arrangement 100. FIG. 4A illustrates a patient in a substantially horizontal position, and FIG. 4B illustrates a patient in a Trendelenburg position. In the Trendelenburg position, shown in FIG. 4B, a patient is typically laid flat on the back (supine position) with the feet higher than the head, approximately 15-30 degrees from horizontal. These figures illustrate merely two example patient positions which may be utilized with the overlay pad arrangement 100 of the present general inventive concept, but the present overlay pad arrangement 100 is not limited to any particular patient size or position to provide increased comfort, weight distribution, and reduced sliding on a surgical table.

Various example embodiments of the present general inventive concept provide an overlay pad 110 that includes a pressure-reduction foam made from foam rubber and including a thermally active "visco-elastic" foam rubber material. Various example embodiments of the present general inventive concept may provide various different amounts of the thermally active visco-elastic foam rubber material. When the foam rubber included in the overlay pad 110 is at a warmer temperature the foam is softer and more pliable, and when the foam layer is at a cooler temperature the foam is harder and retains its shape but may tend to conform to the shape of the patient.

In various example embodiments, the overlay pad 110 may be approximately 1 inch thick or more, and may have no foam "memory". For example, it is possible to fold and/or roll-up the overlay pad 110, for example in a sleeping-bag-like arrangement, for shipping and/or storage convenience, and the material of the gel infused foam is configured to be unrolled and/or unfolded from the stored arrangement for use, where the pad 110 is configured with no memory so as to be capable of lying flat on the table surface without portions of the pad 110 having a tendency to lift-off the table surface due to memory from the rolled-up and/or folded position.

In various example embodiments, the overlay pad 110 may include an expanded cellular product such as polyurethane foam. The density may be considered a high density foam on the order of 3.6 to 3.9 lbs/ft$^3$ with a Differential Pressure Air Permeability (ASTM D3574 test) of on the order of approximately 7 to 13. The overlay pad 110 may be a gel-infused polyurethane or visco-elastic foam. Such a foam is designed to absorb and distribute pressure from a patient. It also provides support which may evenly distribute body weight and provide long lasting durability. It may wick away body heat to aid in consistent sleep temperature, provide stability, and reduce motion transfer.

In various example embodiments, the bean bag device 120 can be made of dried beans, polyvinyl chloride pellets, expanded polystyrene or expanded polypropylene. Such bean bag devices 120 generally conform to the shape of the patient and provide stability to patients in different positions.

Use of an overlay pad arrangement 100 such as the one illustrated in the Figures may minimize the interface pressure of the high interface pressure points between the patient and patient-support surface, such as the surgical table 104. The weight of a patient supported on a conventional surface cover for a surgical table 104 is supported primarily by the head, shoulder blades and sacrum. The above-noted portions of the patient are the downwardly extending extremities of the patient when resting on a conventional surface cover for a surgical table 104 and, as a result, these extremities of the patient support most of the weight of the patient and experience the highest interface pressure between the patient and patient-support surface. It can also be seen that several portions of the patient have low interface pressures against patient-support surface and even no contact with patient-support surface. Use of a overlay pad arrangement 100 according to various example embodiments of the present general inventive concept may minimize pressure ulcers, neuropathy, and/or other nerve disorders and damage to nerve bundles that my result from prolonged exposure to high interface pressures.

In various example embodiments of the present general inventive concept, the overlay pad 110 may include a gel-infused, heat wicking foam pad that evenly distributes patient body weight along the overlay pad 110 to provide support and stability, wherein the composition may substantially prevent motion transfer. Such a property may be advantageous, for example, in steep Trendelenburg positioning.

In various example embodiments the overlay pad 110 may be a thermally active shock absorbing polyurethane visco-elastic foam. Visco-elastic foam may be formulated so that the firmness and support characteristics of the foam may maintain a generally constant durometer hardness and which provides the same support and firmness characteristics at different operating temperatures. The overlay pad 110 may easily conform to the shape of the patient carried on the table surface even if the position of the patient is temporarily changed. In various example embodiments, the overlay pad 110 may be formed from a unitary foam piece, or from a plurality of sections, such as foam blocks.

In various example embodiments, the overlay pad 110 may be made from a thermally active shock absorbing polyurethane foam that is formulated as a visco-elastic foam. Thus, the support and firmness characteristics of the foam pad may easily conform to the shape of the patient carried on the table.

The patient may be monitored during positioning and intraoperatively to assess for patient movement, so that the overlay pad 110 and bean bag device 120 may be adjusted if necessary. The materials of which the overlay pad 110 is constructed according to various example embodiments of the present general inventive concept to aid in the prevention of slipping or other movement of the patient relative to the surgical table 104, and have the added convenience of being disposable, as well as reducing pressure points to make the patient more comfortable.

It is noted that the simplified diagrams and drawings do not illustrate all the various connections and assemblies of the various components, however, those skilled in the art will understand how to implement such connections and assemblies, based on the illustrated components, figures, and descriptions provided herein, using sound engineering judgment.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While the present general inventive concept has been illustrated by description of several example embodiments, it is not the intention of the applicant to restrict or in any way limit the scope of the inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings.

The invention claimed is:

1. A foam overlay pad configured to be removably placed on a separately formed patient positioning bean bag device to support a patient on an operating table, the foam overlay pad comprising:

a top surface configured to contact and conform with the patient's body when the patient is placed on the foam overlay pad; and a bottom surface configured to contact and conform with a top surface of the bean bag device such that portions of the bottom surface are configured to bridge and fill gaps formed between rigid protuberances in the top surface of the bean bag device when the patient is placed on the foam overlay pad wherein the bean bag device is separately formed from the foam overlay pad, and wherein the foam overlay pad is removably placeable on the top surface of the bean bag device, and wherein the foam overlay pad is configured such that when the bottom surface of the foam overlay pad contacts a raised portion of the top surface of the bean bag device, a cellular structure of the foam overlay pad allows portions of the bottom surface of the foam overlay pad to be drawn down into the gaps of the bean bag device to form a smooth and continuous interface, such that the bottom surface of the foam overlay pad mates continuously with the top surface of the beam bag so as to be merged into the gaps and the protuberances of the bean bag device such that the bottom surface of the overlay pad and the top surface of the bean bag device are melded together.

2. The foam overlay pad of claim 1, wherein the foam overlay pad comprises a pressure reduction foam made from foam rubber including a thermally active gel infused visco-elastic material having a cellular structure configured to be drawn into the gaps formed on the top surface of the bean bag device.

3. The foam overlay pad of claim 2, wherein the gel-infused visco-elastic foam has a density of approximately 3.6 to 3.9 lbs/ft$^3$.

4. The foam overlay pad of claim 2, wherein the foam overlay pad is configured to be rolled-up for shipping and/or storage, and is configured to return to its original flat shape immediately upon being unrolled.

5. The foam overlay pad of claim 2, wherein the cellular structure comprises an expanded cellular product such as polyurethane foam, and werein the density is on the order of 3.6 to 3.9 lbs/ft3 with a Differential Pressure Air Permeability (ASTM D3574 test) on the order of approximately 7 to 13.

6. The foam overlay pad of claim 1, wherein the thermally active gel infused visco-elastic material comprises a thermally active shock absorbing polyurethane foam.

7. The foam overlay pad of claim 1, wherein the foam overlay pad comprises low foam memory such that when the overlay pad is folded or rolled-up, the overlay pad returns to an unrolled or unfolded shape such that the foam overlay pad lies flat on the operating table without portions of the overlay pad lifting off the operating table due to memory from the rolled-up and/or folded position.

8. The foam overlay pad of claim 1, wherein the thermally active get infused visco-elastic material is configured such that when the foam rubber is at a warm temperature, the foam is soft and pliable, and when the foam rubber is at a cool temperature the foam is hard and retains its shape.

9. The foam overlay pad of claim 1, wherein the themally active gel infused visco-elastic material is configured such taht the firmness and support characteristics of the foam overlay pad maintains a gererally constant durometer hardness at different operating temperatures.

10. The foam overlay pad of claim 1, wherein the bean bag device is configured to provide support for rough or coarse positioning of the patient; and wherein the foam overlay pad is configured to provide fine positioning by filling the gaps and wrinkles created in the top surface of the bean bag device following a geometry of the bean bag device without subjecting the patient's body to discontinuities of the gaps and wrinkles to maintain the patient accurately in position.

11. The foam overlay pad of claim 1, wherein the foam overlay pad comprises gel-infused polyurethane foam having a cellular structure configured to be drawn down into the gaps and wrinkles on the top surface of the bean bag device.

12. A system for positioning a patient on an operating table, the system comprising:

a patient positioning bean bag device; and a separately formed foam overlay pad configured to be removably placed on the bean bag device, the foam overlay pad comprising:

a top surface configured to contact and conform with the patient's body, and a bottom surface configured to contact and conform with a top surface of the bean bag device such that portions of the bottom surface are configured to bridge and fill gaps between rigid protuberances in the top surface of the bean bag device to reduce pressure points of the bean bag device against the patient's skin and to increase skip protection of the patient's skin against the top surface of the bean bag device, wherein the bean bag device is separately formed from the foam overlay pad, and the foam overlay pad is removably palceable on the bean bag device, and wherein the foam overlay pad comprises a pressure reduction foam made from foam rubber including a thermally active visco-elastic material.

13. The system of claim 12, wherein the foam overlay pad comprises gel-infused polyurethane foam having a cellular structure configured to be drawn down into wrinkles and crevisces on the top surface of the bean bag device.

14. The system of claim 12, wherein the bean bag device is configured to provide support for rough or coarse positioning of the patient; and wherein the foam overlay pad is configured to provide fine positioning by filling gaps and wrinkles created in the top surface of the bean bag device following a geometry of the bean bag device without subjecting the patient's body to discontinuities of the gaps and wrinkles to maintain the patient accurately in position.

15. The system of claim 12, wherein the thermally active visco-elastic material is configured such that when the foam rubber is at a warm temperature, the foam is soft and pliable, and when the foam rubber is at a cool temperature the foam is hard and retains its shape.

16. The system of claim 12, wherein the overlay pad comprises an expanded cellular product such as polyurethane foam, and wherein the density is on the order of 3.6 to 3.9 lbs/ft3 with a Differential Pressure Air Permeability (ATSM D3574 test) on the order of approximately 7 to 13.

17. The system of claim 12, wherein the foam overlay pad is configured such that when a surface of the foam overlay pad contacts a raised portion of the top surface of the bean bag device, a cellular structure of the foam overlay pad allows portions of the bottom surface of the foam overlay pad to be drawn down into the wrinkles and crevices of the bean bag device to form a smooth and continuous interface, such that the bottom surface of the foam overlay pad mates continuously with the top surface of the bean bag so as to be merged into crevices and the protuberances of the bean bag device such that the two surfaces are melded together.

18. A method of supporting a patient on an operating table during a medical procedure, the method comprising:

positioning a bean bag device on the operating table;

positioning a separately formed foam overlay pad on a top surface of the bean bag device; and positioning a patient on the foam overlay pad so as to maneuver the bean bag device into a patient support position such that a bottom surface of the foam overlay pad bridges and fills gaps between rigid protuberances formed on the top surface of the bean bag device when the bean bag device has been maneuvered into the patient support position while maintaining a smoother upper surface of the overlay pad.

19. The method of claim 18, wherein the foam overlay pad comprises gel-infused polyurethane foam having a cellular structure configured to be drawn down into wrinkles and crevices on the top surface of the bean bag device.

20. The method of claim 19, wherein the gel-infused polyurethane foam has a density of approximately 3.6 to 3.9 $lbs/ft^3$.

* * * * *